US005368172A

United States Patent [19]

Barringer

[11] Patent Number: 5,368,172

[45] Date of Patent: Nov. 29, 1994

[54] TABLE TENNIS PADDLE AND BALL HOLDER

[76] Inventor: Ben G. Barringer, 702 S. 34th St., Mesa, Ariz. 85204

[21] Appl. No.: 26,024

[22] Filed: Mar. 4, 1993

[51] Int. Cl.[5] ..... A47F 7/00

[52] U.S. Cl. ..... 211/13; 211/15

[58] Field of Search ..... 211/13, 14, 87, 15; 273/30

[56] References Cited

U.S. PATENT DOCUMENTS

| | | | |
|---|---|---|---|
| 2,221,704 | 11/1940 | Farley | 211/14 X |
| 2,767,854 | 10/1956 | Barrett | 211/13 |
| 3,064,823 | 11/1962 | Shock | 211/13 X |
| 3,842,979 | 10/1974 | Doelcher | 211/14 |
| 4,125,192 | 11/1978 | Dayen | 211/14 |
| 4,211,406 | 7/1980 | Roesler et al. | 211/14 X |

*Primary Examiner*—Robert W. Gibson, Jr.

[57] ABSTRACT

A wall-mounted table tennis paddle and ball holder made of a durable plastic or other suitable material, compact in size having a rectangular box shape with approximate outer dimensions of 2¾' in depth, 9¾" in height and 16" in length.

It consists of: A paddle-shape (less handle) paddle housing wall, which houses up to 3 conventional size paddles at either end; A "ball in" ≈ 1½" dia. opening above paddle housing area, at either end of upper part of front panel, for returning of balls to holder; A retractable ball housing/dispenser. Said housing/dispenser, which will house up to 6 conventional size balls, is located vertically in the center of holder between the two paddle housing areas and between back wall and front panel. Said housing/dispenser having an upper and lower "stop" flange to prevent it from extending more than 2½" below bottom wall of holder when set up for use. The said housing/dispenser being flush with the outer bottom wall of holder during shipping and storage.

8 Claims, 2 Drawing Sheets

TABLE TENNIS PADDLE AND BALL HOLDER

BACKGROUND OF THE INVENTION

1. Field of Invention

This invention relates to devices used for the supporting of apparatus used in the playing of table tennis, in particular the secure housing of table tennis paddles and Balls in close proximity to the playing table for easy access of said equipment.

2. Description of the Prior Art

Prior art for table tennis supporting devices of this type is typified by U.S. Pat. No. 713,762 by Haskell and U.S. Pat. No. 4,125,192 by Dayen. Accordingly, a Haskell type holder has much of the entire paddle surface in contact with the holder which may cause abrasion and wear of the paddle head material. The device for holding the table tennis balls is a simple 6-ball tray of approximately ½ of the ball height whereby any minor bumping or shaking can cause both paddles and balls to fall out of the device causing damage or loss of equipment.

The Dayen type support rack is designed to keep paddles and balls from falling out if shaken and to prevent the paddle heads from coming in contact with the support rack by resting on the paddle handle, thus preventing the abrasion wear and warping of the paddle heads. This may be true while the paddle is resting in the holder, but unless a person is very careful (as young kids may not be) while putting the paddle head through a slot type rack, the striking surface of the paddle can rub against the sides of the slot in the process of being put away or taken out, which may still cause abrasions and wear. Also, and more importantly, in this type rack the horizontal member, or the part protruding away from the wall, holds four paddles with space between each paddle slot plus more space to include the ball holding device, which means that the horizontal member part of rack, extends approximately 8" or more away from the wall thus making it much more likely for someone to run into it causing possible injury to the person and possible damage to equipment and rack.

It is the objective of this invention, while taking into consideration the good and bad points of prior art, to present an entirely new and improved design while accomplishing the same task of providing a paddle and ball holder which: 1. Allows quick and easy removal and return of equipment to holder, 2. Provides a new designed housing around the paddles and balls, giving more "all around" protection and in particular to the paddle for minimizing abrasion wear and warping, 3. By having a short 2¾" depth, minimizes being bumped into, 4. Will keep the paddles and balls from falling out of the holder if bumped or jarred, 5. Can be wall-mounted in close proximity to playing table for ready access of equipment.

Holder is intended to be produced of a durable, high quality, vacuum formed plastic or any other suitable state-of-the-art material or manufacturing process.

3. Brief Description of Drawings

DESCRIPTION OF AND REASONS FOR THE NEW DESIGN OF THE PADDLE AND BALL HOLDER

In the following text, the symbol ≈ will be used for approximate.

Figure 1:
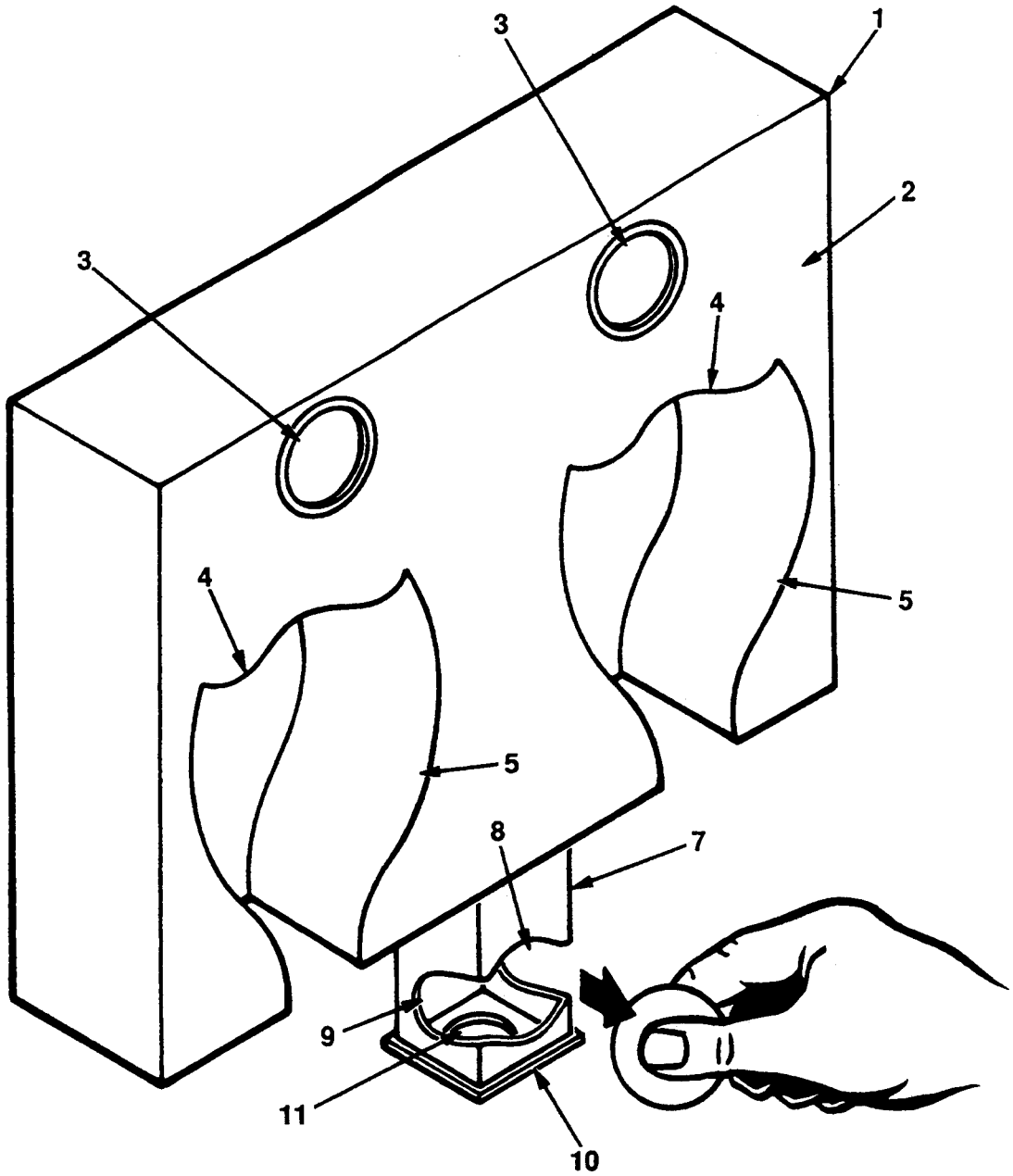
FIG. 1 shows: an Isometric view of the paddle and ball holder with the retractable ball housing/dispenser in place as seen, when in use; a hand showing easy removal of ball, through front opening of the ball housing/dispenser, by using thumb and finger; an approximate size of holder by comparing to hand; A "ball in" opening for return of balls to holder and also shows the paddle housing areas.

With reference to the drawings, FIG. 1 shows the table tennis paddle and ball holder in an isometric view as it would be seen when mounted in close proximity to the playing table for quick and easy access of said equipment. Design emphasis was placed on keeping to a minimum the depth of the holder from the wall. The depth, being ≈2¾", provides a greater safety factor from a person bumping into it, thus minimizing possible injury to the person and damage to the holder and equipment. It is ≈9¾" in height (not including the ≈2½" of the protruding part of retractable ball housing/dispenser) and ≈16" in length. The holder will house 6 conventional size paddles (3 at either end) and 6 conventional size balls while allowing for variations in size of said equipment. At the top and either end of the front panel is a "Ball in" opening of ≈1½" dia. for returning of balls to holder. At the top end of paddle-shape housing, of front panel, is a paddle containment flange.

Figure 2:
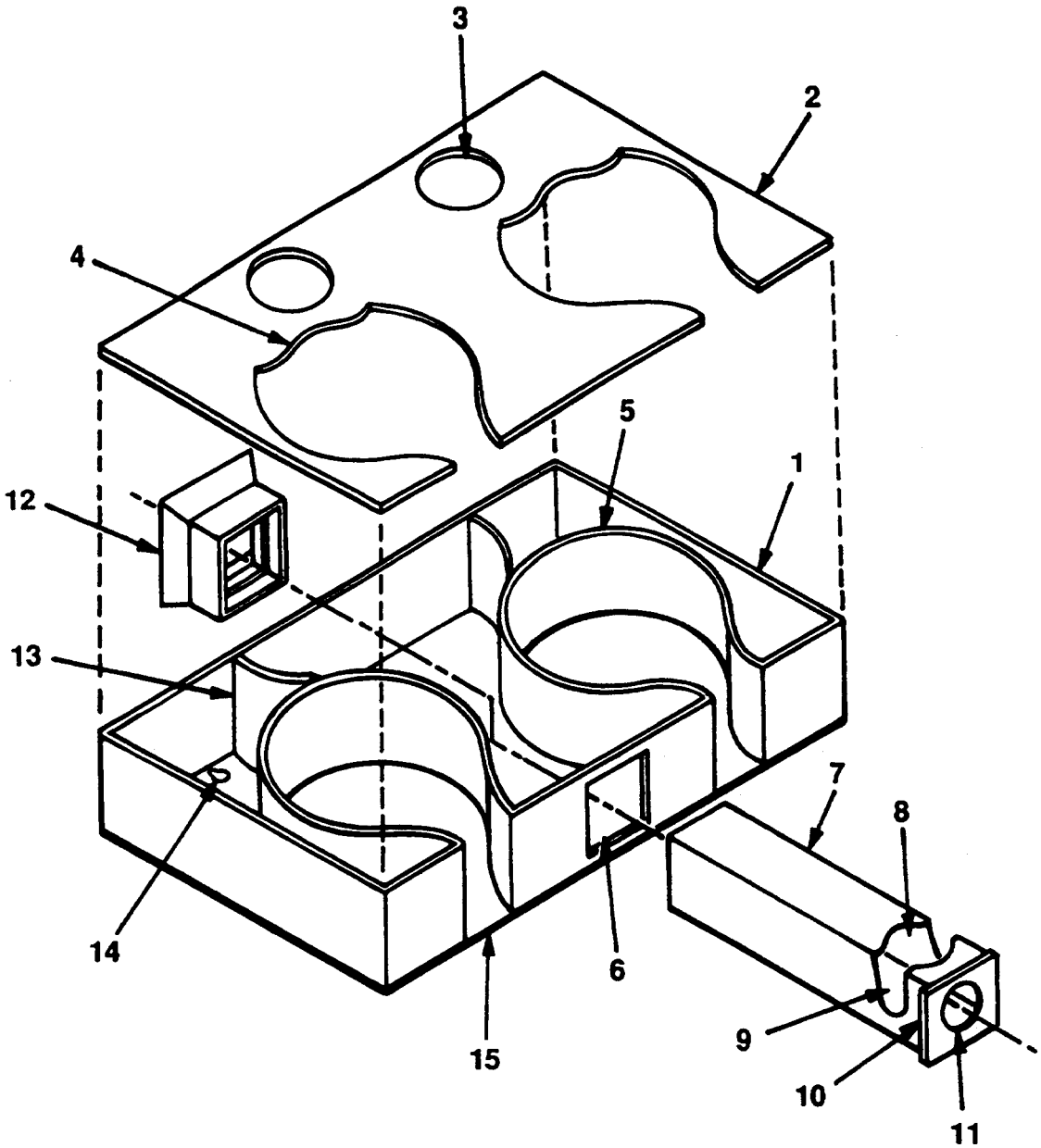
FIG. 2 shows: an Isometric exploded view of the paddle and ball holder at a different angle, in order to show more clearly the design of an inner ball path and paddle housing walls plus comprising parts and workings of the retractable Ball housing/dispenser along with a parts legend.

With reference to the drawings, FIG. 2 shows that the paddle-shape (less handle) cut-out of the front panel 2, has a paddle containment flange 4 at the upper part of cut-out. When front panel 2 is attached to holder body 1, said flange 4, along with a small part of the paddle lower edge resting on curved "convex" part of paddle housing wall 5, will keep the paddles from falling out of holder 1, even if bumped or jarred. The Paddle-shaped (less handle) housing wall 5 has an opening at the bottom end to accept paddle handle. Most of the paddle handle will rest outside of holder 1 when housed, making it easy for paddle removal and return. Paddles being returned to paddle housing 5 will first be tilted so as to pass under the paddle containment flange 4, then pushed vertically towards back wall 15 of paddle housing 5, with the order reversed for removal. The bottom end of "convex" curved wall surface of paddle housing 5 allows only a small part of the lower portion of the paddle edge to rest on said wall surface 5 when housed. Because of this, and because the paddle housing 5 being larger than the paddle itself (including variation in paddle sizes), abrasion wear and warping of the paddle heads will be minimized, during housing or while being removed and returned to/from holder. The retractable ball housing/dispenser 7 is made to receive the cap with angled upper "stop" Flange 12. Only after passing through square opening 6, located in the lower wall of holder 1, can the two pieces now be permanently glued, so when the retractable ball housing/dispenser 7 is pulled out, by placing finger in opening 11, the angled upper "stop" flange part of cap 12 will come to a "stop" and rest between the two curved paddle housing walls 5, while the other two edges of the angled upper "stop" flange 12 will rest flush against the inner surface of front panel 2 and back wall 15. This along with the snug fit of retractable ball housing/dispenser 7, through square opening 6, will keep retractable housing/dispenser with cap 7+12 sturdy when pulled out for use or pushed in for shipping and storage. When pushed in, the lower "stop" flange 10, being larger than the square opening 6, will come up to and "stop" flush to the bottom wall of holder 1. The "retractable" part is designed for the purpose of creating a simple and more compact packaging and shipping container for holder (shortens 2½" from height×16" in length), while eliminating any packaging design problems and also serves to minimize breakage of protruding part, by allowing some give if bumped, as compared to a non-moving part. It also works extremely well in the dispensing of balls.

The curved-wall part of ball path 13, connects to top wall of holder 1 and top part of paddle housing wall 5 at either end. The said curved wall 13 along with part of paddle housing wall 5 and upper "stop" flange part of cap 12 make up the ball path area for ball to follow and fall into the retractable ball housing/dispenser 7 and come to rest in the ball "in place" opening 11. Now it can be gripped by thumb and finger, through thumb and finger opening 9, and removed from ball holder/dispenser 7, by pulling ball out, through ball removal opening 8.

The holder having a wall-mounting hole 14, at either end, for securing to a wall or any vertical surface.

The foregoing is considered to be illustrative only of the principles and specific embodiment of the invention. It is not intended to limit the invention strictly to what is described herein but is to include modification and similarities falling within the scope of the invention herein claimed, to include other games in which a paddle and ball are used, and also to include any packaging of table tennis balls, or other games in which a ball is used, in a modified ball housing/dispenser as a part of, or separate entity, for the dispensing of game balls.

What is claimed is:

1. A table tennis paddle and ball holder comprising:

a housing comprising a back wall, a front panel, and an upper sidewall, a lower sidewall and end sidewalls intermediate and joining said back wall and said front panel;

said back wall having a means for securing said housing to a vertical surface;

a first curved inner wall extending between and joined to said back wall and said front panel; said first curved inner wall having ends terminating on either side of an opening in said lower sidewall through which a tennis paddle handle can extend; said first curved inner wall having a configuration intermediate said ends of said first inner wall generally complementary to a ball striking surface of a head of a tennis paddle whereby the head of at least one tennis paddle can be supported by said first curved inner wall;

said front panel having a tennis paddle head opening therein in registry with said first curved inner wall; said tennis paddle head opening having a configuration generally conforming to said configuration of said first curved inner wall except at an upper portion which extends downwardly with respect an upper portion of said first curved inner wall to form a paddle containment flange; and a retractable ball retaining and dispensing means slidably mounted in said lower sidewall; and said front panel having a ball opening means therein in communication with said retractable ball retaining and dispensing means for loading balls into said retractable ball retaining and dispensing means.

2. The table tennis paddle and ball holder of claim 1, including:

a second curved inner wall extending between and joined to said back wall and said front panel; said second curved inner wall having ends terminating on either side of a second opening in said lower sidewall through which a tennis paddle handle can extend; said second curved inner wall having a configuration intermediate said ends of said second inner wall generally complementary to a ball striking surface of a head of a tennis paddle whereby the head of at least one tennis paddle can be supported by said second curved inner wall;

said front panel having a second tennis paddle head opening therein in registry with said second curved inner wall; said second tennis paddle head opening having a configuration generally conforming to said configuration of said second curved inner wall except at an upper portion which extends downwardly with respect to an upper portion of said second curved inner wall to form a paddle containment flange; and said retractable ball retaining and dispensing means being mounted in said lower sidewall intermediate said first curved inner wall and said second curved inner wall.

3. The table tennis paddle and ball holder of claim 2, wherein: opposing surfaces of said first curved inner wall and said second curved inner wall define a ball path for guiding balls from said ball opening means to said retractable ball retaining and dispensing means.

4. The table tennis paddle and ball holder of claim 2, wherein: said first curved inner wall has a portion extending up to said upper sidewall; said second curved inner wall has a portion extending up to said upper sidewall; and opposing surfaces of said first curved inner wall and said second curved inner wall define a ball path for guiding balls from said ball opening means to said retractable ball retaining and dispensing means.

5. The table tennis paddle and ball holder of claim 4, wherein: said ball opening means comprises first and second ball openings in said front panel.

6. The table tennis paddle and ball holder of claim 4, wherein: said retractable ball retaining and dispensing means has a square horizontal cross section with a front wall, a rear wall and two sidewalls; a ball removal opening in said front wall adjacent a lower end of said retractable ball retaining and dispensing means; and thumb and finger openings in said sidewalls of said retractable ball retaining and dispensing means on either side of said ball removal opening to facilitate the removal of balls from said retractable ball retaining and dispensing means.

7. The table tennis paddle and ball holder of claim 6, wherein: a bottom wall of said retractable ball retaining and dispensing means has a central opening therein with a diameter less than the diameter of a ball so that a ball in position to be removed from said retractable ball retaining and dispensing means rests in said central opening.

8. The table tennis paddle and ball holder of claim 7, wherein: said retractable ball retaining and dispensing means has an upper flange means which rests on said opposing surfaces of said first and second curved inner walls when said retractable ball retaining and dispensing means is in an extended position and a lower flange means which abuts against an outer surface of said lower sidewall when said retractable ball retaining and dispensing means is in a retracted position to limit the movement of said retractable ball retaining and dispensing means.

* * * * *